US006560992B2

(12) United States Patent
Corduan et al.

(10) Patent No.: US 6,560,992 B2
(45) Date of Patent: May 13, 2003

(54) ADJUSTMENT PROCESS FOR A LOW-TEMPERATURE RECTIFICATION UNIT

(75) Inventors: Horst Corduan, Puchheim (DE); Dietrich Rottmann, Munich (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/957,469

(22) Filed: Sep. 21, 2001

(65) Prior Publication Data

US 2002/0088702 A1 Jul. 11, 2002

(30) Foreign Application Priority Data

Sep. 21, 2000 (DE) ..... 100 47 102

(51) Int. Cl.[7] ..... F25J 3/100
(52) U.S. Cl. ..... 62/643; 62/656
(58) Field of Search ..... 62/643, 656

(56) References Cited

U.S. PATENT DOCUMENTS 4,784,677 A 11/1988 Al-Chalabi
5,224,351 A 7/1993 Jeannot
5,505,051 A * 4/1996 Darredeau et al. ..... 62/656
5,590,544 A * 1/1997 Corduan et al. ..... 62/656
5,592,834 A * 1/1997 Darredeau et al. ..... 62/656
5,901,580 A 5/1999 Darredeau et al.
5,996,373 A 12/1999 Greter

FOREIGN PATENT DOCUMENTS

| | | |
|---|---|---|
| DE | 37 32 363 | 4/1989 |
| EP | 299 751 | 1/1989 |
| EP | 935 109 | 8/1999 |
| FR | 2 676 371 | 11/1992 |

* cited by examiner

*Primary Examiner*—Ronald Capossela
(74) *Attorney, Agent, or Firm*—Millen, White, Zelano & Branigan, P.C.

(57) ABSTRACT

For adjusting the capacity of a low-temperature rectification unit having a high pressure column and a low pressure column in which a fluid is introduced into the high pressure column (1) and in which liquid from the bottom of the high pressure column is directed into the low pressure column (2), the amount of liquid that is removed from the bottom of high pressure and fed to the low pressure column (2) is controlled via flow adjustment (4), wherein a nominal value for flow adjustment (4) is set to a desired amount of flow, and the liquid level of the liquid at the bottom of column (1) that operates at higher pressure is fixed without a set nominal value corresponding to the amount of liquid that is removed.

13 Claims, 2 Drawing Sheets

ADJUSTMENT PROCESS FOR A LOW-TEMPERATURE RECTIFICATION UNIT

FIELD OF THE INVENTION

The invention relates to a process for adjusting the capacity of a low-temperature rectification unit having a high pressure column and a low pressure column which a fluid is introduced into the high pressure column, and in which liquid from the bottom of the high pressure column is directed into the low pressure column.

BACKGROUND OF THE INVENTION

Adjustment processes for changing the capacity of a low-temperature rectification unit in which a nominal value is set as a correcting value for the bottom level in the column that operates at higher pressure are known. By changing the nominal value of the bottom level, the unit is adjusted to an altered amount of working fluid. The change in capacity is also called load alteration. In the case of a change in the amount of working fluid accompanied by a load alteration, a change in the ratio of liquid to vapor (L/V ratio) temporarily occurs in the rectification column. This change brings about an undesirable change in the purity of the products. The known adjustment processes therefore have the goal of keeping the L/V ratio as constant as possible so that the products of the rectification unit have the same purity for various types of loads of the unit. This is achieved in all known processes by an adjustment of the bottom level that uses the liquid level as a correcting value. Such adjustment processes are known from, for example, publications EP 0 654 436 or U.S. Pat. No. 3,912,476.

Moreover, it is known to use buffer storage to keep the L/V ratio constant. This method is associated with a considerable structural expense, however.

In addition, it is known that not only in the case of capacity changes must measures be taken to keep the L/V ratio constant, but also in the case of the occurrence of malfunctions. For example, fluctuations in the amount of air in an air separation unit lead to different liquid feeds into the bottom of the column that operates at higher pressure. In the known bottom level adjustment, which keeps the bottom level constant, the altered amount of liquid feed and the altered amount of liquid flow are sent on. That is to say that variable flows pass from the bottom of the column that operates at higher pressure into the column that operates at lower pressure. This has a negative effect in the column that operates at lower pressure, since the variable liquid feed disrupts rectification.

The object of the invention is therefore to make available a process that ensures low-temperature rectification with uniform product purity with load variation, such as also in the case of malfunctions with varying amounts of working fluid.

SUMMARY OF THE INVENTION

This object is achieved according to the invention in that the amount of liquid that is removed from the bottom of the column that operates at higher pressure and that is fed to the column that operates at lower pressure is controlled via flow adjustment, whereby a nominal value for the flow adjustment is set to a desired amount of flow, and the liquid level of the liquid at the bottom of the column that operates at higher pressure is permitted to self adjust without a set nominal value corresponding to the amount of liquid that is removed. In this case, as flow adjustment, preferably an FIC (Flow-Indicated Control) unit is used as an adjustment component. This unit usually has a flowmeter, as well as at least one valve that can be actuated and that is connected to the flowmeter via a control line.

The low-temperature rectification unit is preferably a low-temperature rectification unit for air separation. A bottom level indicator (level indicator) is used especially preferably to increase the operating safety, in addition to adjust the flow, and its purpose consists in indicating going above a set maximum value for the bottom level, as well as dropping below a set minimum value. It is advisable for a warning signal to be issued in the event the values described go above or below the permitted range.

A further development of the invention provides that in addition to the column that operates at higher pressure and the column that operates at lower pressure, the low-temperature rectification unit has an argon column with a top condenser, and liquid from the bottom of the column that operates at higher pressure is directed into the top condenser and from the top condenser into the column that operates at lower pressure, whereby the amount of liquid that is removed from the bottom of the column that operates at higher pressure is controlled via flow adjustment, whereby a valve is actuated that determines the amount of fluid to be supplied to the column that operates at lower pressure, and a valve is actuated that can allow the appropriate amount of fluid to flow into the top condenser of the argon column.

It is especially advantageous for the degree of opening of the two valves to be set by means of split-range adjustment. In this case, a distribution of the amount of liquid that is removed from the bottom is carried out. The distribution of the amount is advantageously given in portions to the two valves. In the case of a change in the amount of flow, the valve positions automatically adapt according to the portions that they handle.

Especially advantageously, in the case of an increase in the capacity of a low-temperature rectification unit, no nitrogen-rich liquid that is stored outside of the column that operates at higher pressure is fed into the column that operates at higher pressure. The bottom and the attached network in the column that operates at higher pressure and optionally the top condenser of the argon column are preferably used as liquid buffers in the case of load changes. Keeping the L/V ratio constant is thus facilitated. A combination of the two as buffer storage is also advantageously used.

The invention has the advantage that even with fluctuations in the amount of working fluid, only a constant amount of liquid is removed from the bottom of the column that operates at higher pressure. As a result, the liquid feed remains constant and undisturbed in the column that operates at lower pressure. The rectification in the column that operates at lower pressure remains entirely unchanged. The product purity stays the same. In addition, flow adjustment is a reliable adjustment method that can be carried out simply with few components required.

The change in the amount of working fluid becomes apparent in each case only in a change of the bottom level, which is self adjusting without set nominal values corresponding to the amount of liquid that is removed from the bottom of the column that operates at higher pressure. To increase the reliability, only a maximum value and a minimum value are specified for the bottom level. It is advisable for a warning signal to be issued when the value goes above the specified maximum for the bottom level and when the value drops below the specified minimum. Within these limits, the bottom level of the column that operates at higher pressure can drop or increase, without this having disturbing effects on the rectification.

For the case that a warning signal indicates that the value goes above the specific maximum or goes below the specified minimum for the bottom level, several measures are available that all aim at bringing the bottom level back into the range that is not critical between the maximum and minimum values. All measures have in common the fact that one or more of the fluid streams that flow out of the column that operates at higher pressure or into the latter are changed as regards their throughput.

For example, when the maximum value for the bottom level is exceeded, the amount of liquid removed from the bottom increases or the amount of feed air is reduced. The feed amount of the nitrogen-rich liquid into the column that operates at lower pressure or into a storage tank can also be increased.

In the case the value goes below the minimum for the bottom level in the column that operates at higher pressure, the above-mentioned measures are carried out with opposite signs.

BRIEF DESCRIPTION OF THE DRAWINGS

Below, the invention is explained in more detail based on the embodiments that are depicted diagrammatically in the figures.

DETAILED DESCRIPTION OF THE DRAWINGS

Figure 1:
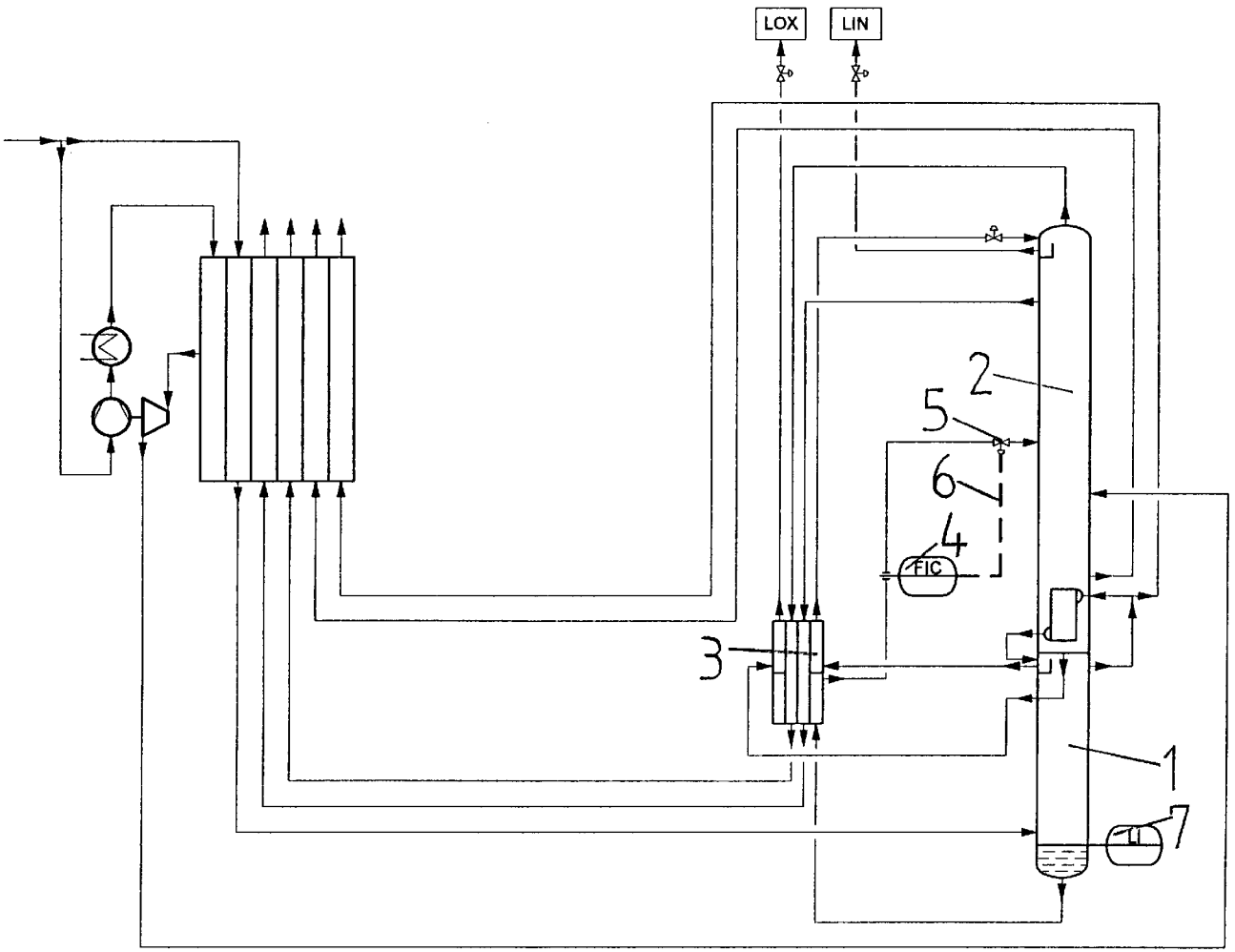
FIG. 1 is a schematic diagram of a low-temperature rectification unit that has an FIC adjustment for performing the process according to the invention.

In particular, FIG. 1 shows a column 1 that operates at higher pressure, a column 2 that operates at lower pressure, an subcooler 3, as well as an FIC (Flow-Indicated Control) adjustment 4, a valve 5, as well as a control line 6. The liquid that is removed from the bottom of column 1 that operates at higher pressure is directed via subcooler 3 into FIC-adjustment 4, which has a flowmeter. The flow and the resulting introduction via valve 5 into column 2 that operates at lower pressure is adjusted in such a way that the L/V ratio in column 2 also remains constant in the case of the varying amount of feed air. Especially advantageously, the flow of the fluid is measured after the fluid has passed subcooler 3. To increase the reliability, a bottom level indicator 7 (level indicator 7) is advantageously mounted in the area of the bottom of column 1 that operates at higher pressure, which issues a signal in the event of the value going above a specified maximum for the bottom level and in the event of the value going below a specified minimum.

Figure 2:
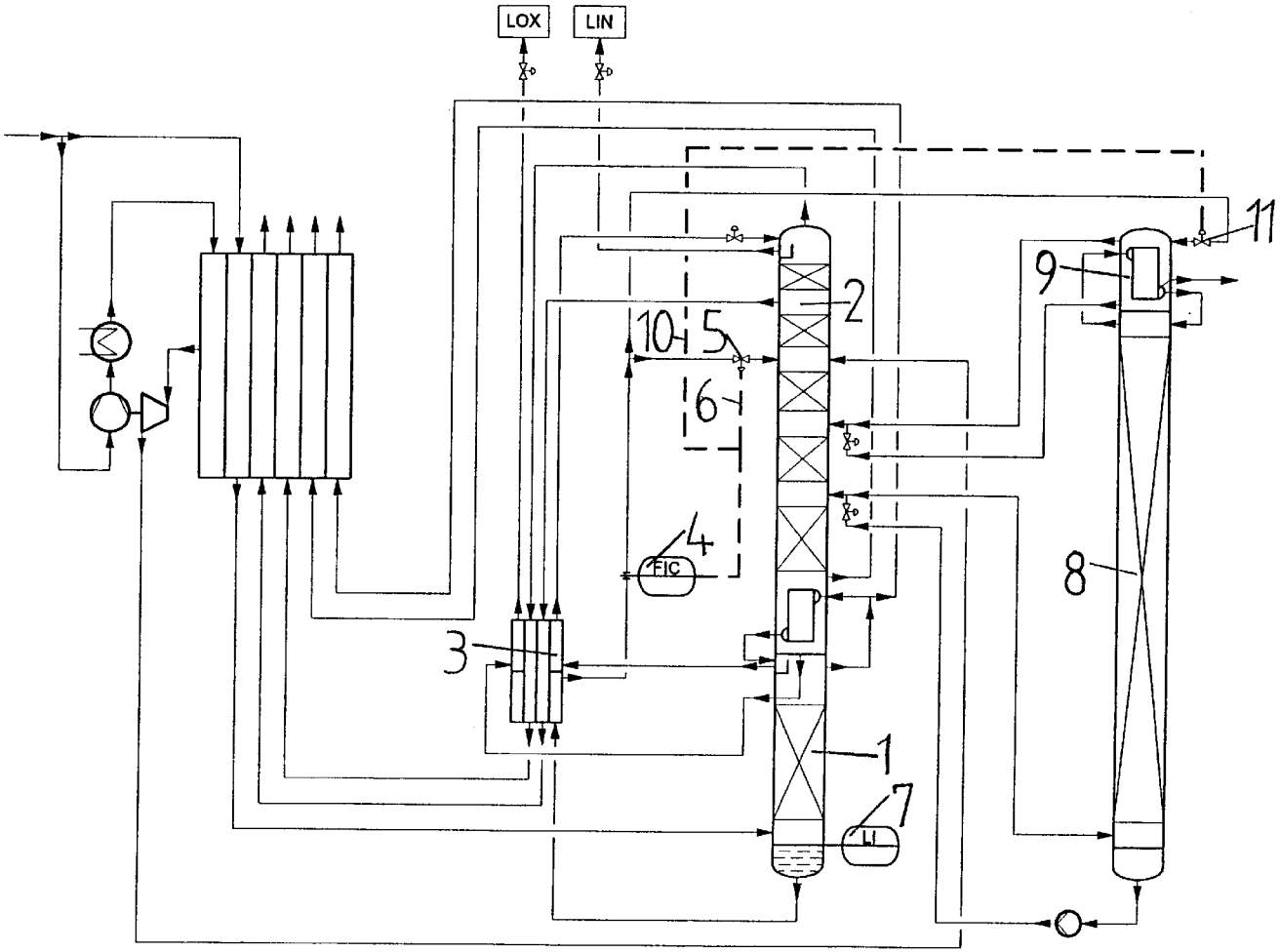
FIG. 2 is a schematic diagram of a low-temperature rectification unit with an argon column, whereby for performing the process according to the invention, an FIC adjustment is provided that actuates two valves.

In addition to the components already described in the section via FIG. 1, FIG. 2 shows an argon column 8, a top condenser 9 of argon column 8, and a second control line 10, which actuates a second valve 11, through which the input amount of fluid is fed to top condenser 9 of argon column 8. FIC adjustment 4 is implemented in this example as split-range adjustment 4, by which it is ensured that the distribution of the amount of liquid that is removed from the bottom is adapted to two valves 5, 11 in a change of the flow amount by the FIC unit, in such a way that the valve positions automatically readjust corresponding to the portions of fluid that they handle.

The entire disclosures of all applications, patents and publications, cited above [or below], and of corresponding German application No. 100 47 102.1 filed Sep. 21, 2001 are hereby incorporated by reference.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In a process for adjusting the capacity of a low-temperature rectification unit having a high pressure column (1) and a low pressure column (2), comprising passing a fluid into the high pressure column (1) and passing liquid from the bottom of high pressure column (1) through a conduit into the low pressure column (2), the improvement comprising setting a nominal value for the desired amount of flow of liquid from the bottom of the high pressure column (4) to the low pressure column (2) and adjusting a flow valve (5) integrated with said conduit so as to obtain the desired amount of flow in response to said set value and permitting the liquid level of the liquid at the bottom of high pressure column (1) to self-adjust, without being dependent on a set nominal value, corresponding to the amount of liquid that is removed.

2. A process according to claim 1, wherein the low-temperature rectification unit is a low-temperature rectification unit for air separation.

3. A process according to claim 2, wherein in the case of an increase in the capacity of the low-temperature rectification unit, no nitrogen-rich liquid stored outside of the high pressure column (1) is fed into said high pressure column (1).

4. A process according to claim 1, further comprising an argon column (8) with a top condenser (9), and passing liquid from the bottom of high pressure column (1) into the top condenser (9) and from top condenser (9) into low pressure column (2) and actuating a valve (5) to control the amount of liquid removed from the bottom of high pressure column (1) via flow adjustment (4), and supplied to the low pressure column (2) and a valve (11) to control the amount of fluid to flow into top condenser (9) of argon column (8).

5. A process according to claim 4, wherein the degree of opening of two valves (5, 11) is set by means of split-range adjustment (4).

6. A process according to claim 4, wherein the rate of withdrawal of liquid from the bottom of the high pressure column is constant.

7. A process according to claim 4, wherein the ratio of liquid to vapor (L/V) in the low pressure column is constant.

8. A process according to claim 4, wherein within a predetermined maximum and minimum height of the liquid level in the high pressure column the desired amount of liquid flow from the bottom of the high pressure column remains independent of the liquid level in the bottom of the high pressure column.

9. A process according to claim 1, wherein the process is continuous and the amount of liquid removed from the bottom of the high pressure column (1) changes in response to process conditions.

10. A process according to claim 1, wherein the rate of withdrawal of liquid from the bottom of the high pressure column is constant.

11. A process according to claim 1, wherein the ratio of liquid to vapor (L/V) in the low pressure column is constant.

12. A process according to claim 1, wherein within a predetermined maximum and minimum height of the liquid level in the high pressure column the desired amount of liquid flow from the bottom of the high pressure column remains independent of the liquid level in the bottom of the high pressure column.

13. A process according to claim 1, wherein the desired amount of liquid flow from the bottom of the high pressure column remains independent of the liquid level in the bottom of the high pressure column.

* * * * *